United States Patent [19]

Briggs

[11] 3,975,044

[45] Aug. 17, 1976

[54] REEVING SYSTEM FOR A SCISSOR-TYPE CLAMSHELL BUCKET

[75] Inventor: Aubrey C. Briggs, Carnegie, Pa.

[73] Assignee: Dravo Corporation, Pittsburgh, Pa.

[22] Filed: Feb. 28, 1975

[21] Appl. No.: 553,895

Related U.S. Application Data

[63] Continuation of Ser. No. 386,314, Aug. 7, 1973, abandoned.

[52] U.S. Cl. ..... 294/70; 37/185; 212/81; 294/111

[51] Int. Cl.[2] ..... B66C 3/06

[58] Field of Search ..... 294/70, 71, 106, 107, 294/111, 112, 118, 120; 37/183 R, 184–188; 212/17, 42, 44, 81, 84, 127, 129; 214/147 G, 656, 657, 658

[56] References Cited

UNITED STATES PATENTS

| | | | |
|---|---|---|---|
| 479,149 | 7/1892 | Gale | 37/185 |
| 985,417 | 2/1911 | Johnson | 212/127 |
| 1,111,719 | 9/1914 | Miller | 214/656 X |
| 1,168,279 | 1/1916 | Brosius | 37/188 |
| 1,225,186 | 5/1917 | Seymour | 214/656 |
| 2,617,211 | 11/1952 | Olson | 37/185 |
| 3,402,824 | 9/1968 | Zweifel | 212/17 |
| 3,544,150 | 12/1970 | Van Huuksloot | 294/71 |
| 3,767,060 | 10/1973 | Briggs | 212/81 |
| 3,807,783 | 4/1974 | Van Huuksloot | 294/70 |

FOREIGN PATENTS OR APPLICATIONS

| | | | |
|---|---|---|---|
| 530,868 | 8/1954 | Belgium | 294/70 |

*Primary Examiner*—Johnny D. Cherry

*Attorney, Agent, or Firm*—Parmelee, Miller, Welsh & Kratz

[57] ABSTRACT

This invention relates to a bucket assembly, as for example, a clamshell-type bucket assembly for use in a material handling apparatus, such as, for example, a ship unloader. More particularly, this invention relates to a novel bight-of-line reeving system for use in a scissors-type bucket assembly.

1 Claim, 14 Drawing Figures

REEVING SYSTEM FOR A SCISSOR-TYPE CLAMSHELL BUCKET

This is a continuation of application Ser. No. 386,314, filed Aug. 7, 1973, now abandoned.

A number of types of reeving arrangements for use with clamshell-type buckets are known. In the direct reeved bucket arrangement, the hold and close cables, that is, the cables used to support the weight of the bucket and to open and close the bucket, respectively, each have one of their ends attached directly to the bucket and the other end wound about suitable hoisting means. Another type of bucket arrangement is termed in-bight-of-line, wherein the hold and close cables are reeved around pulleys or sheaves supported in the bucket, with one end of each hold and close line returned upward to the trolley or bucket support structure where the ends are anchored. In the direct reeving arrangement on a typical four-line bucket, two hold and two close cables are commonly used, each pair of cables having to be simultaneously manipulated in order to either respectively open or close the bucket. In the in-bight-of-line arrangement used on a typical four-line bucket, only one hold and one close cable are used, one end of each being wrapped about suitable hoist means and the other ends secured or dead-ended to, for example, the bucket support structure or trolley. The bucket is thus supported by a two-part single holding line and a two-part single closing line. Thus, manipulation of only one close cable and one hold cable is required rather than respective pairs of cables as in the direct reeved arrangement.

Regardless of the reeving system employed, buckets used in material handling apparatus for large tonnages open by gravity. When the closing lines are slacked, the bucket opens and its weight is carried by the holding lines, the bucket being hoisted or lowered by spooling in or paying out these lines. The digging operation is accomplished by a combination of the weight of the bucket forcing the bucket lips into the material and the tightening of the closing lines which brings the lips together. A scissors-type bucket where the closing lines exert a horizontal force on the upper scissor arm which forces the lips to close provides a higher digging force at the bucket lips than does a vertically reeved bucket which has no direct action to force the lips to close, depending only on weight concentrated at the bucket lips. This increased digging force provided by the scissor arm action allows a reduction in the dead weight of the bucket. The lighter bucket permits increased payload capacity for a given total lifting capacity of the hoists and the scissors arrangement provides more protection for the close line from the material being handled, especially when near the closed position. However, since the existing scissors buckets are direct reeved, it is still necessary to manipulate at least four cables, i.e., a pair of hold cables and a pair of close cables, in order to respectively open and close the bucket.

It is, therefore, an object of this invention to provide a bucket assembly which combines the advantageous improved ratio of payload to dead weight of a scissors-type bucket and the advantages of an in-bight-of-line reeving system which on a four-line bucket requires manipulation of only one hold line and one close line rather than manipulating two hold lines and two close lines as in the direct reeving system. Moreover, due to the improved trolley arrangement possible, this improved design permits the hold and close hoists each to take in one line equal to one-quarter of the total lifted load instead of two lines totalling one-half of the lifted load.

BRIEF DESCRIPTION OF THE DRAWINGS

The preferred embodiments of this invention are represented by the following drawings and described in the accompanying detailed description; however, it is to be understood that such drawings and description are presented solely for purposes of illustration and that many variations therein and adaptations thereof may be made by one skilled in the art without departing from the spirit and scope of the invention.

DESCRIPTION OF THE PREFERRED EMBODIMENT

Figure 1:
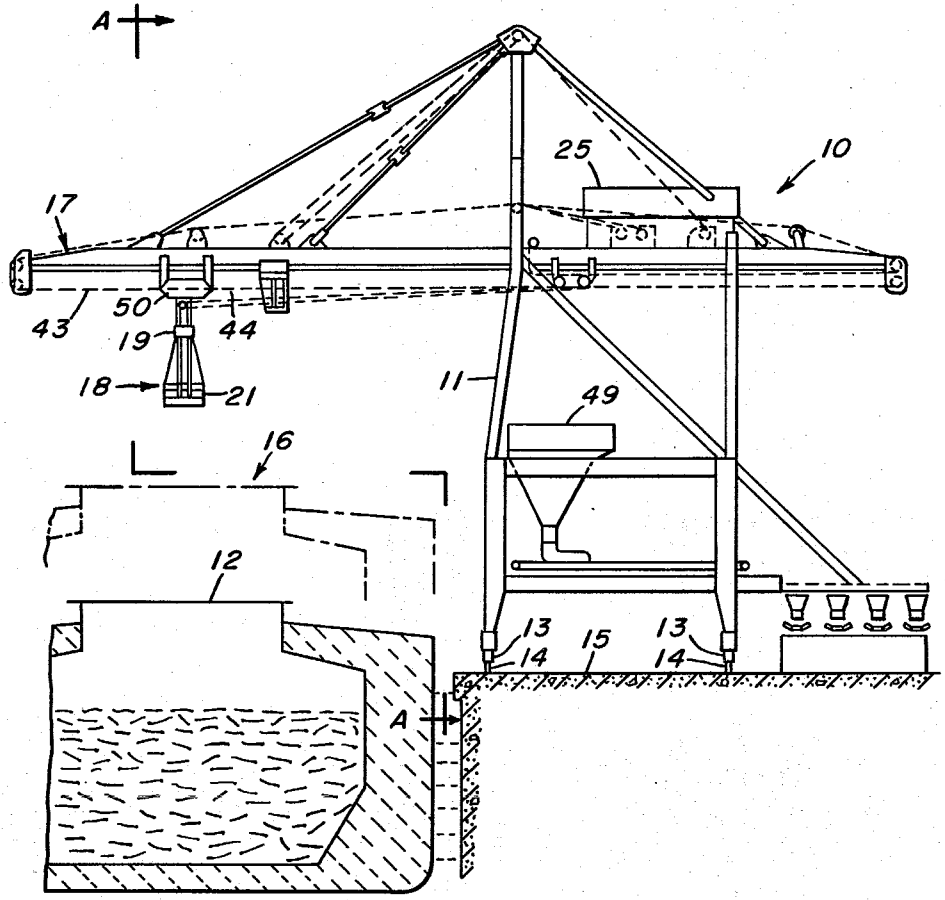
FIG. 1 is a side elevation view of a typical clamshell bucket type ship unloader shown arranged on a pier and having a scissors bucket assembly reeved in accordance with the invention.
Figure 2:
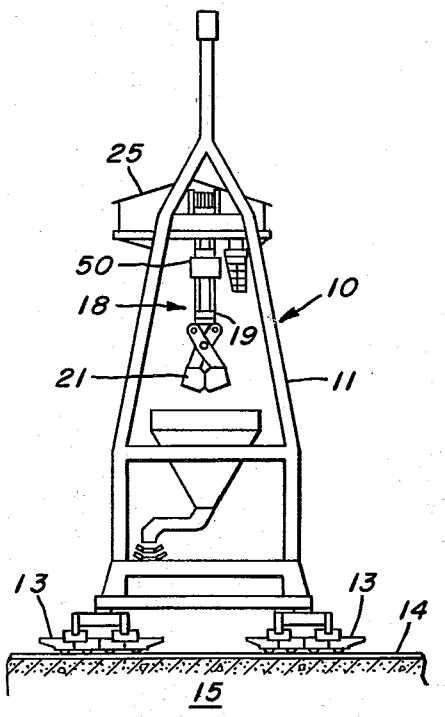
FIG. 2 is a front view of the unloader of FIG. 1 taken along the line A—A.

Referring now to the drawings, FIGS. 1 and 2 show a typical clamshell bucket type ship unloader 10 of well-known construction including a vertical support structure 11 formed of interconnected struts or columns. The support structure 11 is provided with wheeled trucks 13 constructed to ride on rails 14 mounted in the top of a pier 15 to thereby enable the unloader to move along the pier for unloading a cargo ship 16. The unloader 10 is also provided with an elongated, generally horizontally extending, vertically pivotable box-shaped boom or apron 17 which serves as a support and guide for a trolley 50 from which is suspended a bucket assembly 18 reeved in accordance with the invention.

The trolley 50 is of any known construction and tracks along the apron from a position over the hold 12 of the ship 16 to be unloaded, to a position over a hopper 49 or other material receiving means. Rack ropes 43 are employed to move the trolley 50 forwardly along the apron while a compensating rope 44 is used to move the trolley rearwardly along the apron in a manner known to the art.

Figure 3:
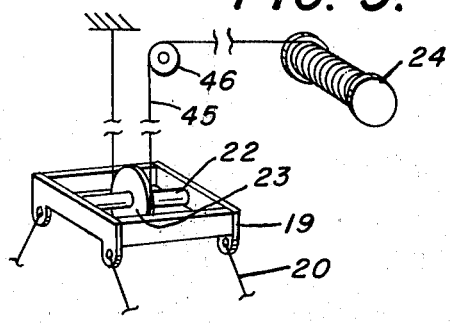
FIG. 3 is a simplified perspective view of the bucket support frame showing a preferred hold-line reeving system.

With reference to FIG. 3, the bucket assembly comprises an open-box support frame 19. Bucket support cables 20 are provided, which cables are secured to the four corners of the frame 19 and to the respective corners of the bucket 21. Horizontally disposed within the frame 19 is a shaft 22 and a sheave 23 mounted for rotation about the shaft 22. Reeved about the shaft is a hold line 45, one end or the live end of which passes over one or more guide sheaves 46 and is wound about hold drum 24 located in the service shelter 25 and the other end or dead end of which is anchored to the trolley 50 or wound about an anchoring drum mounted on the trolley as disclosed in U.S. application Ser. No. 280,224 filed Aug. 14, 1972, now abandoned. It is, of course, to be understood that any other suitable means of dead-ending or anchoring that is known to the art may be employed. Although it is preferred that the bucket hold lines be reeved in-bight-of-line as shown, if desired, the bucket hold lines may be direct reeved in known manner.

With reference to FIGS. 4 to 7, the bucket 21 is preferably a scissors-type clamshell bucket of well-known construction which generally comprises two opposed mirror image parts 26. Each part 26 consists of a jaw or load carrying portion 32 generally defined by a bottom plate 27, two vertically opposed side plates 28 and 29 and, preferably, a back plate 30 and a pair of substantially parallel arms 31 and 31*a* extending diagonally upward in the direction of the jaw portion 32. The arms 31 and 31*a* of each bucket part respectively overlap and are pivotally connected by suitable pivot means, such as for example, a pivot pin 33, thus forming a scissors joint, the upper ends of the arms extending beyond the scissors joint. Other pivot means suitable in this type of bucket construction is described, for example, in U.S. Pat. No. 3,544,150. live

Near the upper ends of the pairs of arms 31 and 31*a* and generally horizontally disposed therebetween are shafts 34 and 34*a* respectively. Mounted for rotation about said shafts 34 and 34*a* are close sheaves 35 and 36 and 35*a* and 36*a* respectively. Below the shafts 34 and 34*a* are shafts 37 and 37*a* generally horizontally disposed respectively between the pairs of arms 31 and 31*a*. Respectively mounted for rotation abouts shafts 37 and 37*a* are guide sheaves 38 and 38*a*.

A close line 39, one end, or the love end 40 of which passes over one or more trolley guide sheaves 47 and is wound about a close drum 42 located in the service shelter 25 and the other end, or dead end 41 of which is anchored by suitable means as discussed hereinabove with reference to the hold line 45, is reeved consecutively about sheaves 38, 36, 36*a*, 35, 35*a*, and 38*a* such that, when a pulling force is exerted on the live end 40 of close line 39, all of the sheaves 35, 35*a*, 36, 36*a*, 38 and 38*a* rotate in a clockwise direction about their respective shafts and tension is exerted in the close line and transmitted to the dead end of the close line, drawing the arms together, thus closing the bucket. It is, of course, to be understood that the live end 40 and the dead end 41 of the close line 39 may be interchanged, in which case a pulling force exerted on the close line 39 would cause all of sheaves 35, 35*a*, 36, 36*a*, 38, and 38*a* to rotate in a counter-clockwise direction about their respective shafts, also closing the bucket.

The just described close-line reeving arrangement utilizing a total of six sheave members has been found to provide a satisfactory digging force upon closure of the bucket; however, it is possible and, in some instances, desirable to employ a lesser number of sheaves, for example, two or four sheave members. One may, if desired, also vary the manner in which the close line is reeved about the various sheave members. FIGS. 8 to 13 are perspective, schematic views which are illustrative, but by no means exhaustive, of the variations within the scope of the invention.

Figure 8:
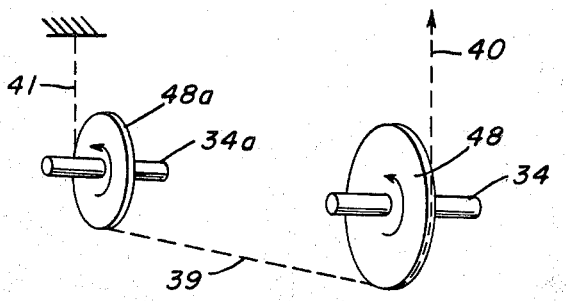
FIGS. 8 to 13 are perspective schematic views exemplary of other embodiments of the reeving system of the invention.

The embodiment illustrated in FIG. 8 is perhaps the simplest of possible arrangements and may be suitable for use with relatively lighter weight, lower capacity buckets. In the arrangement shown in FIG. 8 only two close sheaves 48 and 48*a* are employed, each sheave mounted for rotation about shafts 34 and 34*a*, respectively.

Figure 9:
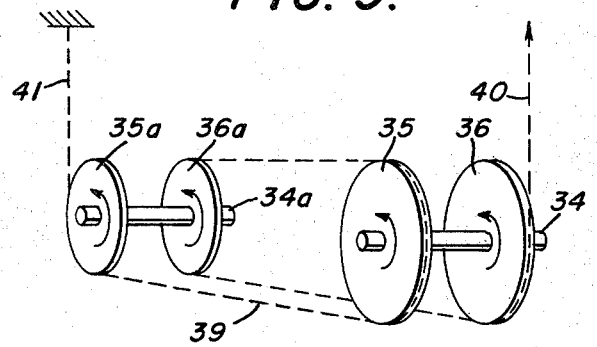
Figure 7:
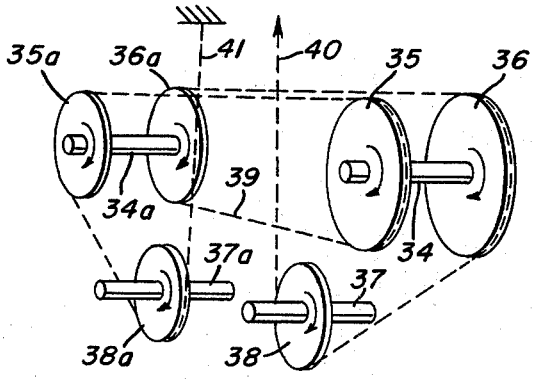
FIG. 7 is a perspective schematic view of the preferred reeving system shown in FIGS. 4 to 6 and 14.

FIG. 9 is illustrative of an embodiment similar to FIG. 7 but with the omission of guide sheaves 38 and 38*a*. In FIG. 9, the close line 39 is reeved consecutively about sheaves 36, 36*a*, 35 and 35*a*.

Figure 10:
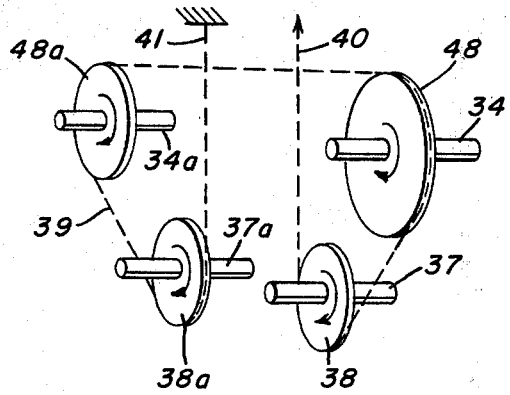

FIG. 10 is similar to the arrangement shown in FIG. 8, employing two close sheaves 48 and 48*a* mounted for rotation about upper shafts 34 and 34*a*, respectively, in addition to guide sheaves 38 and 38*a* mounted for rotation about lower shafts 37 and 37*a*, respectively. In FIG. 10, the close line 39 is reeved consecutively about sheaves 38, 48, 48*a* and 38*a*.

Figure 11:
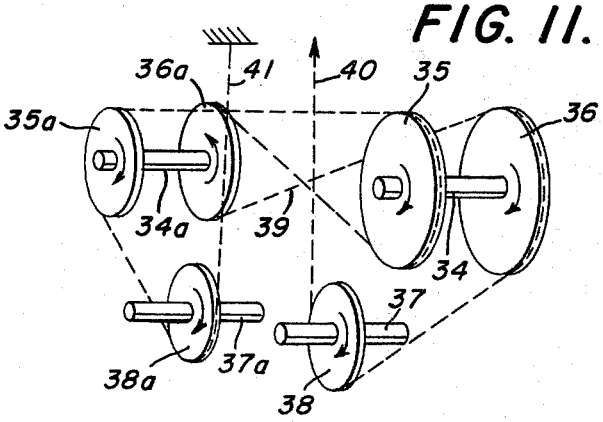

FIG. 11 employs the identical sheave arrangement as shown in FIG. 7; however, in FIG. 7 the portions of close line 39 between sheaves 36 to 36*a* and 36*a* to 35 are reeved horizontally, whereas in the embodiment shown in FIG. 11 the portions of close line between sheaves 36 to 36*a* and 36*a* to 35 are reeved diagonally.

Figure 12:
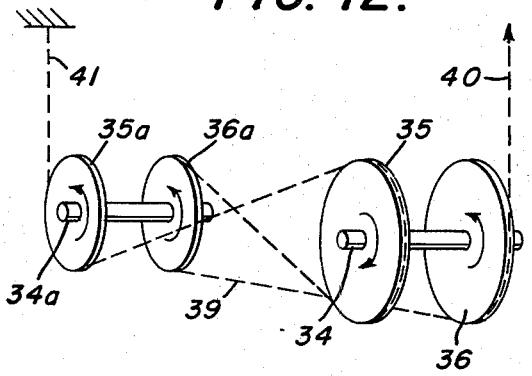
Figure 13:
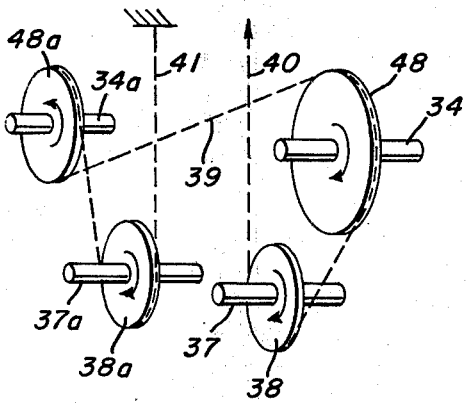
Figure 4:
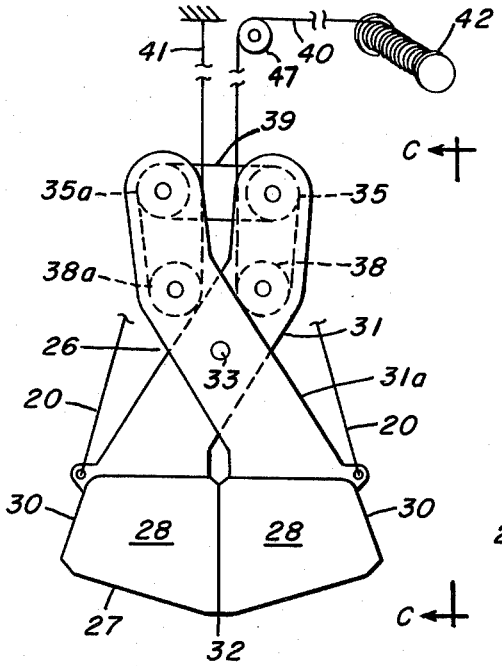
FIG. 4 is a simplified front elevation view of a scissors-type clamshell bucket in closed configuration and reeved in accordance with a preferred mode of the invention.
Figure 5:
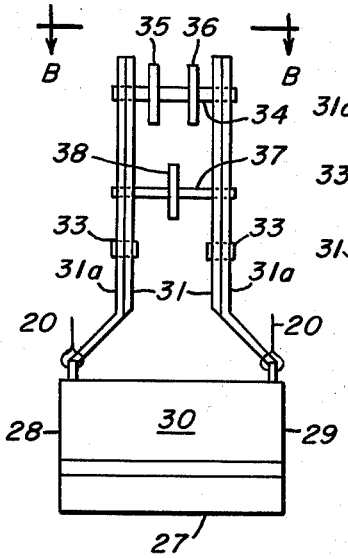
FIG. 5 is a side elevation view of the clamshell bucket of FIG. 4 taken along the line C—C.
Figure 6:
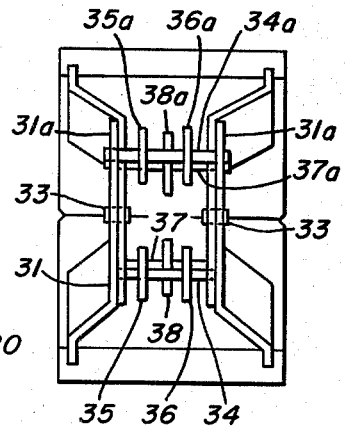
FIG. 6 is a top plan view of the clamshell bucket of FIG. 5 taken along the line B—B.
Figure 14:
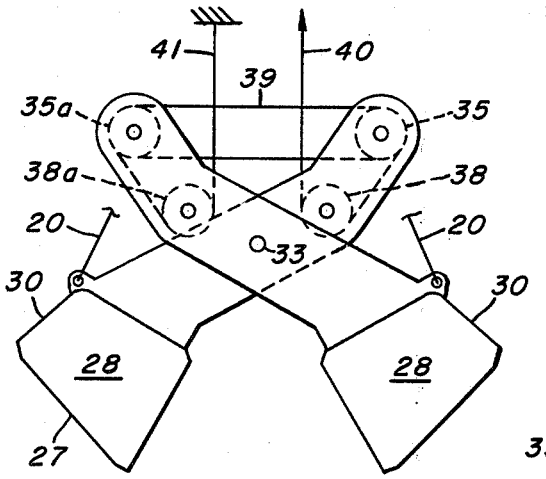
FIG. 14 is the scissors-type clamshell bucket of FIG. 4 showing the bucket in open configuration.

Similarly, FIGS. 12 and 13 are respectively illustrative of diagonal rather than the horizontal close line reeving of FIGS. 9 and 10. It will be further noted that in each of FIGS. 8 to 13, as in FIG. 7, the direction of rotation of the sheave members is indicated by the directional arrows placed thereon.

Notwithstanding the number of sheaves employed or the manner in which the close line is reeved about the sheave members, the crux of the invention resides in the use of only a single close line having a live end and dead end (which live end and dead end are interchangeable as discussed hereinabove) reeved about the sheave members such that, when a pulling force is exerted on the live end of the close line and transmitted through the close line to the dead end of the close line, the bucket arms rotate about the scissors joint resulting in closure of the bucket.

The invention overcomes the disadvantages of prior art direct reeved scissors buckets which require the use of two live close lines upon each of which a pulling force need be simultaneously exerted in order to effect closure of the bucket. Thus, according to the invention, one line accomplishes the same purpose as two lines resulting in a more efficient and economical system.

It is to be further realized that the precise placement and alignment of the sheave members in the upper part of the bucket arms, regardless of the number of sheave members employed, is a function, for example, of the length of the bucket arms, dead weight of the bucket, allowable cable clearances, bucket capacity, type of material being handled and the like, all of which parameters and the relationship among which are well known to the art and are matters of design choice.

It should be further apparent that various modifications can be made to the structure of the bucket assembly without departing from the essence of the invention; for example, the bucket assembly may be mounted on a fixed support rather than the movable trolley arrangement illustrated and may be used in applications other than as a ship unloader.

I claim:

1. In a bucket assembly for use in a material handling apparatus comprising a support structure and a scissors-type clamshell bucket arranged below said support structure, said bucket having a first and second pair of parallel diagonally upward extending arms with one arm in each pair pivotally joined with the corresponding arm in the other pair to form a pair of axially aligned scissors joints, said bucket having hold line and improved close line reeving means, said hold line reeving means comprising sheave means disposed in a frame of box-like construction interposed between the support structure and the bucket, bucket support cables secured to the four corners of the frame and to the respective corners of the bucket, a hold line reeved about said sheave means, said hold line having a live end and a dead end, said live end being wrapped about hoist means mounted on the support structure and said dead end anchored to the support structure, and said improved close line reeving means comprising:

a. first sheave means including at least two sheaves rotatably disposed between the upper ends of said first pair of arms;

b. second sheave means including a sheave rotatably disposed between said first pair of arms below said first sheave means and above the respective scissor joints;

c. third sheave means including at least two sheaves rotatably disposed between the upper ends of said second pair of arms;

d. fourth sheave means including a sheave rotatably disposed between said second pair of arms below said third sheave means and above the respective scissor joints; and e. a close line, having a live end wrapped about hoist means on the support structure and a dead end secured to the support structure, said close line being reeved successively about the sheave of the second sheave means, alternately about the sheaves of the first and third sheave means and then about the sheave of the fourth sheave means, whereby when a pulling force is exerted on the live end of said close line, tension is exerted in the close line and transmitted through the close line to the dead end of the close line, whereby the arms pivot about the scissors joint to close the bucket.

* * * * *